US005131493A

United States Patent [19]

Johansen

[11] Patent Number: 5,131,493

[45] Date of Patent: Jul. 21, 1992

[54] EMERGENCY STAIRS FOR EXTERNAL MOUNTING ON BUILDINGS

[75] Inventor: Stig Johansen, Horten, Norway

[73] Assignee: Histi Development AS, Skoppum, Norway

[21] Appl. No.: 603,712

[22] PCT Filed: May 12, 1989

[86] PCT No.: PCT/NO89/00048

§ 371 Date: Nov. 21, 1990

§ 102(e) Date: Nov. 21, 1990

[87] PCT Pub. No.: WO89/11312

PCT Pub. Date: Nov. 30, 1989

[30] Foreign Application Priority Data

May 24, 1988 [NO] Norway ..... 882251

[51] Int. Cl.[5] ..... A62B 1/00

[52] U.S. Cl. ..... 182/84; 182/47

[58] Field of Search ..... 182/84, 47, 83, 85, 182/86

[56] References Cited

U.S. PATENT DOCUMENTS 176,457 6/1876 Nevins ..... 182/84
653,442 7/1900 Dunk ..... 182/83
748,305 12/1903 Parvin et al. .
1,119,802 12/1914 Brown ..... 182/84
3,951,232 4/1976 Okada .
4,388,982 6/1983 Yonahara .

FOREIGN PATENT DOCUMENTS 730004 3/1966 Canada ..... 182/84
0113329 12/1983 European Pat. Off. .
0151076 8/1985 European Pat. Off. .
2360634 11/1982 Fed. Rep. of Germany .

*Primary Examiner*—Alvin C. Chin-Shue
*Attorney, Agent, or Firm*—Cushman, Darby & Cushman

[57] ABSTRACT

Emergency stairs are designed to be mounted externally on buildings and are provided with platforms at each floor as well as ladders/staircases between the platforms. Platforms are hinged to the house wall and are at their extreme edges connected by the air of mutually articulated connecting means. The ladders/staircases are suspended from the underside of the platforms in articulated members under openings in the platforms and with the rungs of the ladder arranged in parallel with the house wall. The ladders are at their lower ends slidably supported by the next lower platform. In a position of non-use platforms and ladders are retracted into contact with the house wall and may be actuated by an actuating mechanism which may be operated from each floor.

15 Claims, 3 Drawing Sheets

EMERGENCY STAIRS FOR EXTERNAL MOUNTING ON BUILDINGS

Figure 1:
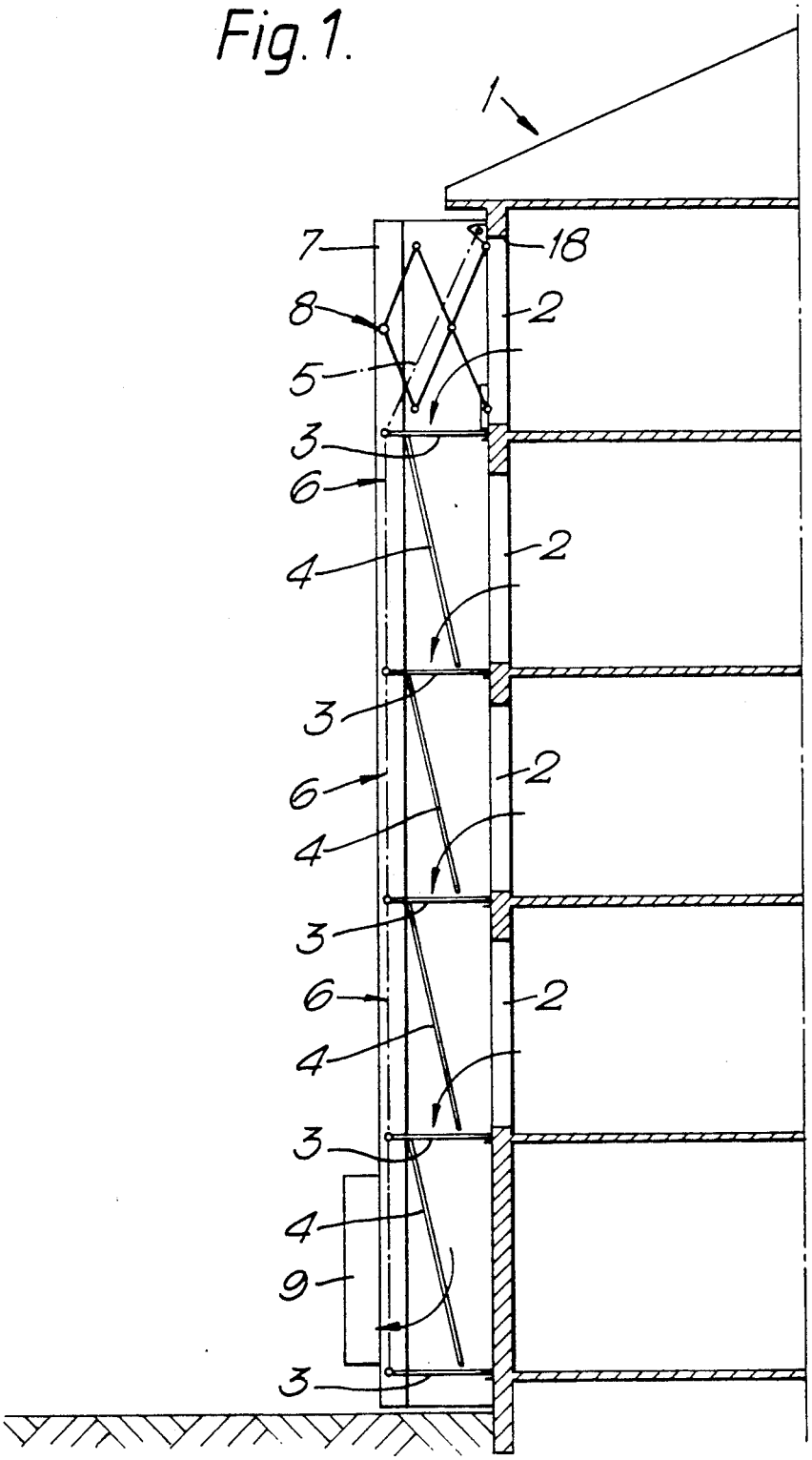

The present invention relates to emergency stairs for mounting outside buildings, and comprising platforms at every floor of the building and ladders/staircases between the platforms.

A series of different emergency stair structures is known to ensure the possibility of evacuating higher building structures, e.g. blocks of flats, hotels, hospitals, homes for the aged, nursing homes, office blocks, schools, etc.

The classical design consisted of stationary ladders, e.g. between balconies of blocks of flats or external metal ladders on office blocks, hotels, etc. Problems in connection with said known approaches were above all that accessibility was difficult, also that the ladders often were too steep, and finally, that such ladders could also be used to provide illegal access to a building for persons not concerned. In order to prevent the last mentioned disadvantage such stationary ladders often ended at quite a distance from the ground, which resulted in further disadvantages. It was, especially, difficult for elderly people to escape, via the known escape devices, also from balconies where it was necessary to open trapdoors and climb down closely to a wall.

Efforts were made to solve these problems, e.g. by a structure as disclosed in German Patent 23 60 634. In said specification a very comprehensive escape route system is disclosed, which is apparently intended for mounting during house building, and which comprises a series of platforms with intermediate ladders. The platforms are intended to be lifted by the aid of a hoisting means and to be placed in the shape of a pack on roof level of the house. This is a very expensive and complicated structure which also necessitates special exits from the building, although it must be said to solve the most essential problems, viz. a safe and comfortable escape route in a critical situation, at the same time as the escape route can be stored at such a high level that there will be no access to the building, via said route under normal circumstances. As mentioned, this will be a most expensive structure, which requires a special design of the building, use of special hoisting and winch means which must be stored in a fire proof manner, and it will also require some maintenance to ensure a state of constant readiness. Such an escape route will, furthermore, require a special structure of the building or buildings and it may constitute quite a dominating factor as regards apperance.

It is an object of the present invention to provide emergency stairs which will represent an escape route as safe as the one disclosed in DE-PS 23 60 634, but with a considerably more simple design, which requires less maintenance, and does not form a dominating factor of a building when not in use. The emergency stairs should also form a safe and very readily utilizable escape route, and it should be safe in that, in case of an accident, a person can only fall a short distance. It is, furthermore, free of ice and snow in the cold season.

This object is achieved by emergency stairs which are characterized by the features appearing from the claims.

By the aid of the invention, emergency stairs are provided which will sit closely adjacent to a wall of a building when not in use and will, thus, be very little conspicuous, also, they cannot be used for climbing up and, furthermore, they will bar the entrances from single floors.

In order to ensure said effects and to make the stairs as inconspicuous as possible they may be provided with an external cover, which will prevent the stairs/rungs from being viewed in a retracted state, and prevent climbing on the outside. An esential, further feature when such a cover is used is that the staircase will also receive a protective shield towards outside environment, which will give the user, in case of an emergency, the impression of moving in a closed staircase. The cover may also be provided with banister means, e.g. chains, or tarpaulins or sheets, e.g. in pockets, to cover the lateral areas as well, if it is desirable to provide an escape staircase which is gastight to a maximum degree.

It should be mentioned that in U.S. Pat. No. 4,388,982 a device is disclosed which might show a certain similarity with the object of the present invention. The American device, however, is a building scaffold which is mounted and secured onto a wall during a phase of building or renovation, and the device according to said U.S. Patent cannot be used in the same manner as the invention, nor can it be collapsed towards the wall of the building without extensive preparatory operations comprising insertion of ladders, closing of trapdoors, etc.

Figure 3:
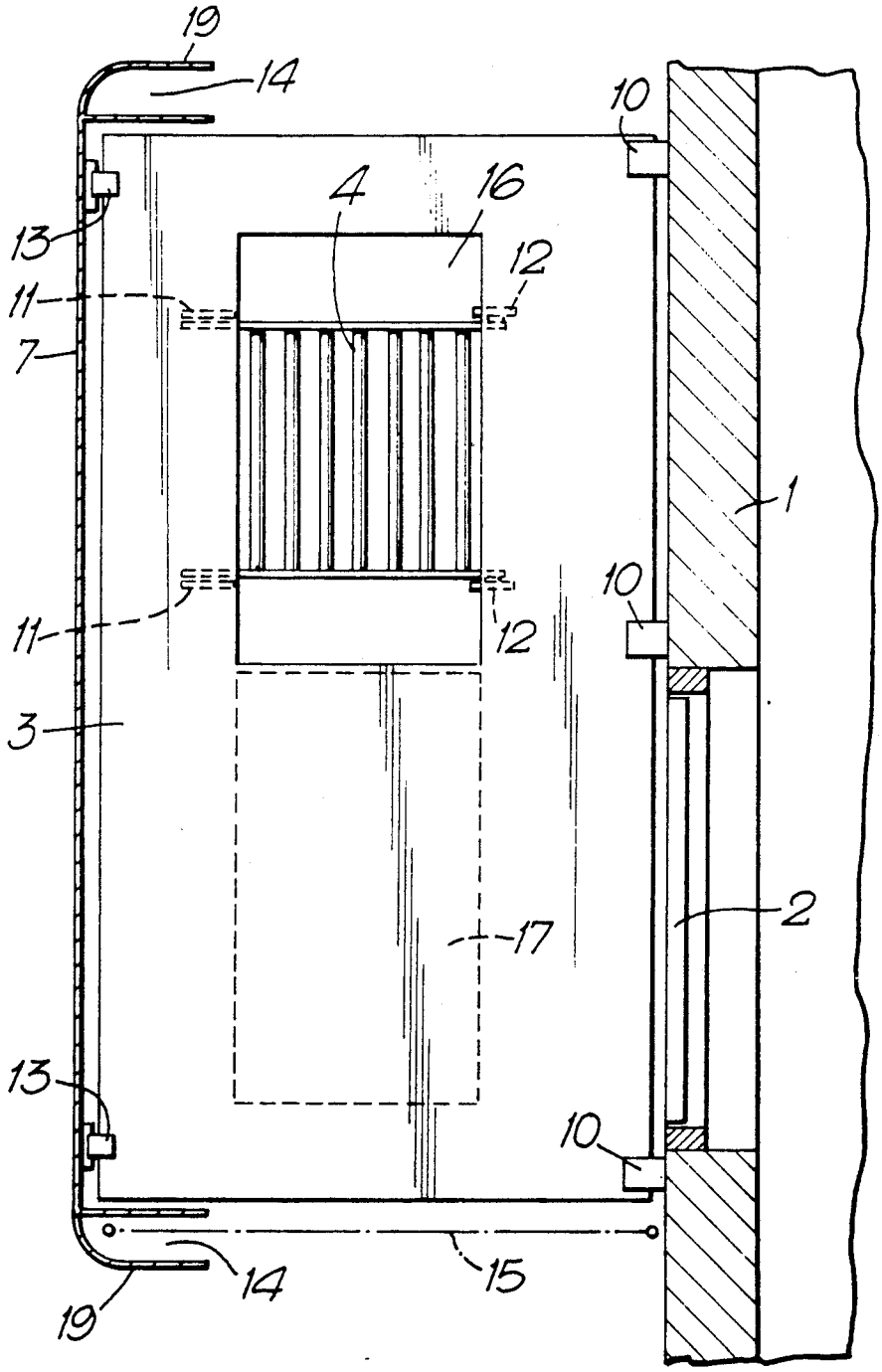

Further it is in EP-A-0113329 and especially FIG. 3 thereof disclosed an emergency stairs for external mounting on buildings with platforms at each floor of the building, there being ladders between the platforms. Each platform is hinged to the house wall, and their outside edges are hingedly connected by at least one connecting member. The ladders are suspended by hinges on the platform and have rungs which are parallel to the wall and are supported by the next platform further down. The platforms can be lowered from their position of contact with the house wall at the same time. However, the disadvantage by this construction is that each platform with its ladder has to be operated separately so that the use of emergency stairs will be dependent of being actuated in correct sequence, and the actuation will also be time consuming.

Figure 2:
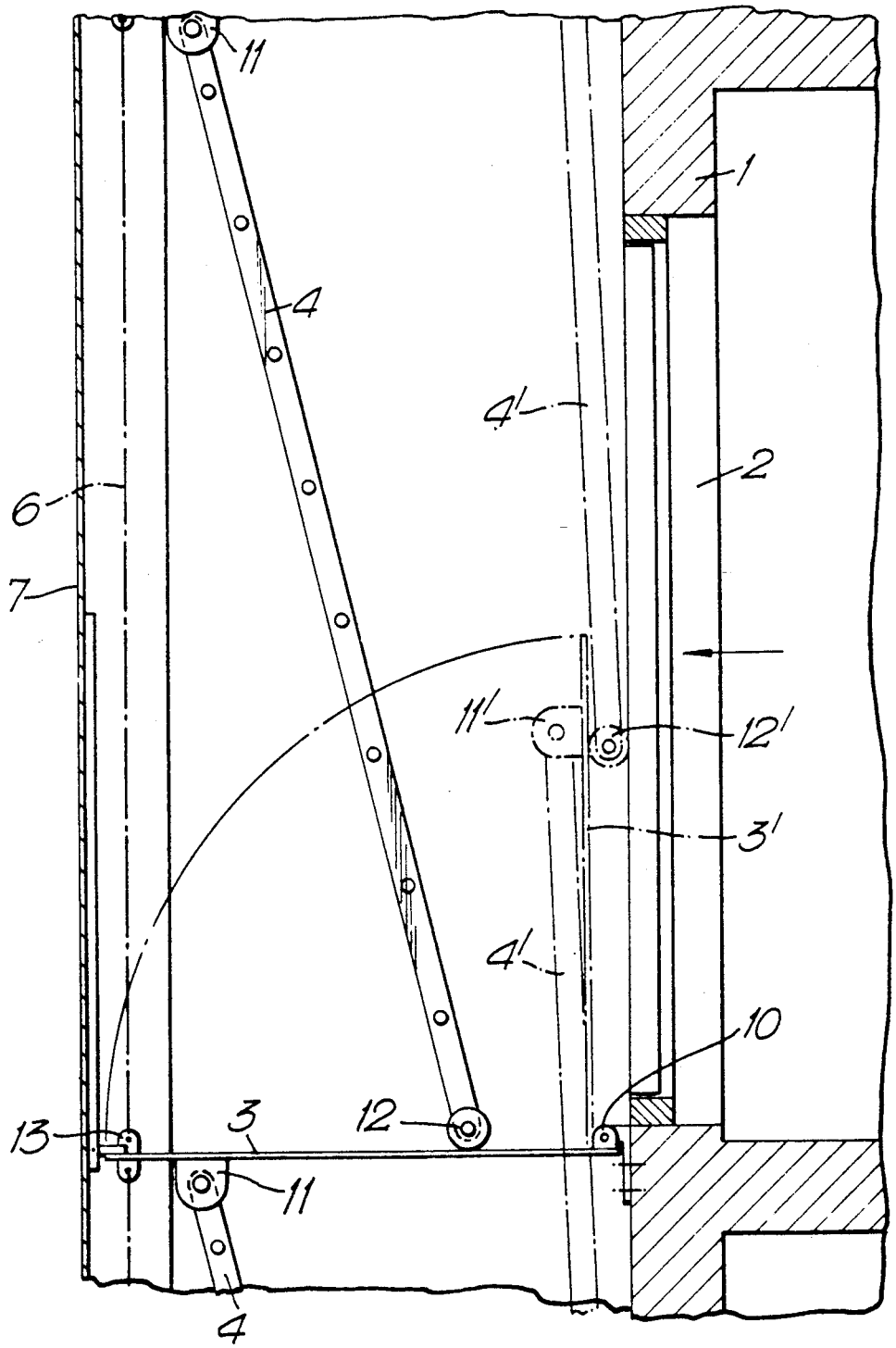

The invention is disclosed in more detail below, with reference to an embodiment which is shown in the drawings, where FIG. 1 is a diagrammatic side elevation of a building with mounted escape stairs according to the invention;

FIG. 2 shows a detailed side elevation of a portion of the emergency stairs as shown in FIG. 1; and FIG. 3 is a diagrammatical view of a platform of the emergency stairs.

Emergency stairs according to the invention are mounted on a building 1, which has, e.g. five floors. Access to the emergency stairs is through openings 2, which may, e.g. be doors at the ends of corridors, but may, if desired, also be other kinds of openings, for instance windows or the like. The kind of opening is of no concern to the invention. Outside said openings 2 the emergency stairs according to the invention are provided. The stairs comprise a separate platform 3 outside each floor, and a plan view of such a platform 3 is shown in FIG. 3. The platforms are maintained in a horizontal position outside each floor by the aid of hinge means 10 connecting platform 3 with the wall of the building, and one or a plurality of interlocking means provided on the outside of platforms 3 and consisting of elements which are diagrammatically shown in the drawing and indicated by numerals 5 and 6. Said interlocking means 5 and 6 may, e.g. be chains to which the platforms are attached by links 13, or they may be other kinds of interlocking means with articulated connections with the platforms. The only essential feature in this connection is that the uppermost securing means 5 should be retractable so that the platform structure can be folded inwards. This can, most advantageously, be obtained by a flexible design of means 5, making them extendable by a suitable mechanism 18 to provide a horizontal position of the platforms when starting from a "retracted" position of the stairs, or to provide a possibility of retraction when the stairs are to be retracted again. From the area indicated at 18, e.g. a rope system extends downwards along the building, on the inside or outside, so that the stairs can, if necessary, be actuated or extended. Such a rope system is not described in detail, but its design will be obvious to those skilled in the art. Hook arrangement 18, may e.g. comprise a sail hook, a snap hook, or the like. Automatical actuation may be arranged, if permitted.

Between each platform 3 a ladder or a staircase 4 is provided (hereafter designated as a ladder), which is attached by a hinge 11 at the lower side of the platform, and which is provided with a slide means, preferably a wheel 12, at its lower end, so that ladder 4 can slide or roll forwards and backwards on the platform. In a position for use the ladder will stand inclined, as illustrated in FIGS. 1 and 2. The ladder 4 is attached adjacent to an opening in the platform, and in case of an emergency it will be possible to pass down through opening 16 in the platform and climb down the ladder to the next platform 4. In order to provide a reliable support for the ladder, and to simplify and also secure the escape route the opening of the next platform is displaced to the location marked 17 in FIG. 3. The ladders are, thus, alternately displaced between platforms. The platforms and the emergency staircase must, obviously, be provided with banisters or the like to prevent people from falling down from the platform. A certain protection is already achieved due to the fact that the ladders are arranged to make users climb on the side facing the house wall, but there will always be a certain hazard at the point where a person climbs down through the opening in the platform. In order to provide maximum safety a protecting cover 7 is preferably provided outside the emergency stairs, which will cover the stairs and form a protection towards the outside. At the same time the emergency stairs will be protected and covered in a collapsed position, so that the emergency stairs will not form a dominating factor on the side of a building. The cover may be designed and manufactured from a material to be adapted to the remaining house wall. Preferably, there should also be provided a lateral banister or the like, indicated by numeral 15 in FIG. 3. Such lateral banisters may consist of chains which are tensioned when the staircase is extended, or they may constitute special elements provided in pockets 14 on cover 7. In such pockets diaphragm rubber elements, tarpaulins, or the like may also be stored if the emergency staircase is to function as a gastight wall and to prevent penetration of noxious gases from outside.

Preferably, the cover is only connected with the platform, via a slide means for guiding and locking, and may then be suspended from a scissors type bar system 8 on each side at the top floor. With such a separately provided cover it is possible to displace the cover towards and out from the wall without displacing the cover in a vertical direction in order to provide full covering for the emergency staircase. Alternatively, the cover may be provided with an inner reinforcement which may act as connecting means, so that the cover is moved in and out with the emergency stairs. This will, however, require a modification of the end portions of the cover and will not result in so decorative an appearance as the first alternative.

At the bottom of the cover a door may be provided, e.g. a lock door if the emergency staircase has to be sealed to be gas tight. If desired, illumination may be provided on each floor.

The retracted position of the emergency stairs is illustrated in dashed lines in FIG. 2. In a retracted position the platform will sit adjacent to the house wall or opening 2, as shown at 3'. In this position ladder 4 will extend as shown at 4', suspended from hinge 11', in a vertical position adjacent platform 3'. Roller 12' is seen at the lower end of ladder 4' from next higher floor inside hinge 11'. The entire ladder or staircase system will in this position extend flattened adjacent to the side of the building and may be covered by cover 7 with side member 19 which will be in contact with building 1 so that the stairs are invisible.

In case of an emergency it will be possible to actuate the stairs from one determined location at each floor by pulling a rope or releasing a rope, or automatically, so that the stairs are actuated, and platform 3 will turn along the arched curve with an arrow, as illustrated in FIG. 2, until connecting member 6 stops further movement and keeps platform 3 in a horizontal position. At the same time ladder 11 with its point will be moved outwards correspondingly sliding by the aid of wheel 12 on top of the next platform below to the correct position. At the same time the cover is activated to assume a covering position outside the stairs so that the user of the stairs will have the feeling of climbing down in a closed room and can safely and carefully move down the staircase and out through lock door 9.

Many modifications are possible within the scope of the invention. It was mentioned that the pattern of movement of the cover may be varied to provide a cover on the side of the stairs as well. Furthermore, openings 16 and 17 in subsequent platforms must not be mutually displaced. In case the stairs must be kept narrow, said openings may also be provided straight beneath each other. Slide means, hinge means, and the design of connecting means may also be varied within the scope of the invention.

The stairs will also be secure all parts of them preferably being manufactured from fire proof material, if desired, of grating in the platforms. A suitable size of the openings in the platforms is approximately 600×900 mm. The ladders are also suitably manufactured from fire proof material, and that goes for the cover too. The actuating system should also be of a fire proof material and is designed as a solely mechanical actuator, not being dependent on electrical power or similar drive means.

The construction thereof may be varied in dependence of the building type. A very simple and safe construction will be to provide a releasable hook device at the top of the building/stairs, with a spring biased level assembly which is connected with a rope which can be actuated with a handle in each floor.

I claim:

1. Retractable emergency stairs for external mounting on a structure with a plurality of floors, comprising a plurality of platforms means, a plurality of step means, and a connecting means, each of said platform means having a top side, a bottom side, and an opening to allow the passage of a person through the platform means, each of said step means having a first end and a second end, each of said platform means having an inner edge for attachment to an external wall of said structure by a hinge means for pivoting a platform means between a retracted, essentially flat position relative to said external wall of said structure and a deployed and ready-for-use position, each of said platform means having an outer edge, each outer edge being connected to said connecting means, said connecting means acting to support said plurality of said platform means in a position essentially perpendicular to said external wall of said struture when said retractable emergency stairs are deployed, said first end of each of said step means being pivotally connected to a bottom side of a platform means at a distance from said inner edge, and said second end of each of said step means being adapted to engage a top side of a subjacent platform means through a slide means.

2. Retractable emergency stairs according to claim 1, wherein said slide means are rollers.

3. Retractable emergency stairs according to claim 1, wherein said connecting means are chains.

4. Retractable emergency stairs according to claim 1, wherein a protective cover is provided outside said plurality of said platform means.

5. Retractable emergency stairs according to claim 4, wherein said protective cover comprises said connecting means.

6. Retractable emergency stairs according to claim 4 or 5, wherein said protective cover is provided with side flanges for complete enclosure of the retractable emergency stairs when in a retracted position.

7. Retractable emergency stairs according to claim 6, wherein said protective cover has pockets for storing gas tight side wall elements and other additional equipment.

8. Retractable emergency stairs according to claim 1, wherein all components of said retractable emergency stairs are manufactured from fireproof materials.

9. Retractable emergency stairs according to claim 1, wherein said openings in said platform means are laterally displaced from said openings in vertically subjacent platform means.

10. Retractable emergency stairs according to claim 1, wherein said second end of each of said step means is located closer to said inner edge of each of said platform means than said first end of each subjacent step means, so that when said retractable emergency stairs are in use, a person will climb each of said step means with their back towards said external wall.

11. Retractable emergency stairs according to claim 1, wherein a lowering means is provided for deploying said retractable emergency stairs and which is actuatable from every floor of said structure.

12. Retractable emergency stairs according to claim 1, wherein a platform means is located at each floor of said structure.

13. Retractable emergency stairs for external mounting on a structure with a plurality of floors, comprising a plurality of platform means, a plurality of step means, and a protective cover, each of said platform means having a top side, a bottom side, and an opening to allow the passage of a person through the platform means, each of said step means having a first end and a second end, each of said platform means having an inner edge for attachment to an external wall of said structure by a hinge means, each of said hinge means for pivoting a platform means between a retracted, essentially flat position relative to said external wall of said structure and a deployed and ready-for-use position, each of said platform means having an outer edge, each outer edge being pivotally connected to said protective cover, said protective cover being displaceable inwards towards said external wall of said structure by the aid of a scissors type bar system and acting to support said plurality of said platform means in a position essentially perpendicular to said external wall of said structure when said retractable emergency stairs are deployed, said first end of each of said step means being pivotally connected to a bottom side of a platform means at a distance from said inner edge, and said second end of each of said step means being adapted to engage a top side of a platform means through a slide means.

14. Retractable emergency stairs for external mounting on a structure with a plurality of floors, comprising a plurality of platform means, a plurality of step means, and a protective cover, each of said platform means having a top side, a bottom side, and an opening to allow the passage of a person through the platform means, each of said step means having a first end and a second end, each of said platform means having an inner edge for attachment to an external wall of said structure by a hinge means, each of said hinge means for pivoting a platform means between a retracted, essentially flat position relative to said external wall of said structure and a deployed and ready-for-use position, each platform means having an outer edge, each outer edge being pivotally connected to said protective cover, said protective cover acting to support said plurality of said platform means in a position essentially perpendicular to said external wall of said structure when said retractable emergency stairs are deployed, first end of each of said step means being pivotally connected to a bottom side of a platform means at a distance from said inner edge, and said second end of each of said step means being adapted to engage a top side of a platform means through a slide means, wherein said retractable emergency stairs are in an essentially flat position and completely covered when not deployed.

15. Retractable emergency stairs according to claim 14, wherein the impression of an enclosed permanent staircase structure is given when the retractable emergency stairs are deployed and being used.

* * * * *